United States Patent [19]

Schumacher et al.

[11] Patent Number: 4,912,367

[45] Date of Patent: Mar. 27, 1990

[54] PLASMA-ASSISTED HIGH-POWER MICROWAVE GENERATOR

[75] Inventors: Robert W. Schumacher, Canoga Park; Julius Hyman, Jr., Los Angeles; Robin Harvey, Thousand Oaks; Joseph Santoru, Valencia, all of Calif.

[73] Assignee: Hughes Aircraft Company, Los Angeles, Calif.

[21] Appl. No.: 181,279

[22] Filed: Apr. 14, 1988

[51] Int. Cl.[4] ..... H01J 23/16; H01J 25/34

[52] U.S. Cl. ..... 315/3.5; 315/111.21; 315/3; 313/231.31

[58] Field of Search ..... 315/111.81, 111.31, 315/111.01, 111.41, 111.91, 5, 3, 3.5, 3.6, 37, 39; 313/231.31, 231.41, 163, 567; 331/126, 79, 81; 333/9934PL, 156, 157, 241

[56] References Cited

U.S. PATENT DOCUMENTS

| | | | |
|---|---|---|---|
| 2,848,649 | 8/1958 | Bryant | 315/39 |
| 3,090,019 | 5/1963 | Johnson et al. | 333/241 |
| 3,099,768 | 7/1963 | Anderson | 315/39 |
| 3,831,052 | 8/1974 | Knechtli | 313/187 |
| 3,852,633 | 12/1974 | Hunter | 315/3.5 X |
| 4,025,818 | 5/1977 | Giguere et al. | 315/337 |
| 4,339,691 | 7/1982 | Morimiya et al. | 315/111.41 X |
| 4,598,231 | 7/1986 | Matsuda et al. | 315/111.81 |
| 4,642,522 | 2/1987 | Harvey et al. | 315/11.81 X |
| 4,697,272 | 9/1987 | Harvey | 372/99 |
| 4,707,637 | 11/1987 | Harvey | 315/111.81 |
| 4,745,336 | 5/1988 | Ohkawa | 331/79 X |

OTHER PUBLICATIONS

SPIE vol. 873 Microwave and Particle Beam Sources and Propagation (1988), W. W. Destler et al., "High Power Plasma Filled Backward Wave Oscillators," pp. 84–91.

J. Feinstein et al., "Status Review of Research on Millimeter-Wave Tubes", IEEE Transactions on Electron Devices, vol. ED-34, No. 2, Feb. 1987, pp. 461–467.

H. K. Florig, "The Future Battlefield: A Blast of Gigawatts?", IEEE Spectrum, Mar. 1988, pp. 50–54.

Gordon T. Leifeste et al., "Ku-Band Radiation Produced by a Relativistic Backward Wave Oscillator", J. Appl. Phys. 59(4), Feb. 15, 1986, pp. 1366–1378.

J. Benford, "High Power Microwave Simulator Development", Microwave Journal, Dec. 1987, pp. 97–106.

D. A. Dunn et al., "Self-Constricted Beam-Generated Plasmas", Proceedings of the Seventh International Conference on Phenomena in Ionized Gases, vol. I, 1966, pp. 429–434.

L. S. Bogdankevich et al., "Theory of Excitation of Plasma-Filled Rippled-Boundary Resonators by Relativistic Electron Beams", Sov. Phys. Tech., Phys. 25(2), Feb. 1980, pp. 143–146.

Y. V. Tkach et al., "Emission by a Relativistic Beam at a Magneto-Cerenkov Resonance in a Periodic Waveguide", Sov. J. Plasma Phys. 5(5), Sep.-Oct. 1979, pp. 566–570.

*Primary Examiner*—Eugene R. LaRoche
*Assistant Examiner*—Seung Ham
*Attorney, Agent, or Firm*—V. D. Duraiswamy; P. M. Coble; W. K. Denson-Low

[57] ABSTRACT

A high-power microwave/mm-wave oscillator is filled with an ionizable gas at a pressure of about 1–20 mTorr, into which an electron beam is injected at a high current density of at least about 1 amp/cm$^2$, but typically 50–100 A/cm$^2$. A plasma is formed which inhibits space-charge blowup of the beam, thereby eliminating the prior requirement of a magnet system to control the beam. The system functions as a slow-wave tube to produce narrow-band microwaves for a gas pressure of about 1–5 mTorr, and as a plasma wave tube to produce broadband microwave/mm-wave radiation for a gas pressure of about 10–20 mTorr. A new high output, hollow-cathode-plasma electron gun is employed in which a metal oxide layer is formed on the inner surface to enhance the secondary electron yield; a cathode, grid, and extraction anode have respective sets of multiple apertures which are mutually aligned to yield a high perveance beam; the cathode, grid, and anode are curved to geometrically focus the beam, and a beam with a circular cross-section is generated.

34 Claims, 6 Drawing Sheets

PLASMA-ASSISTED HIGH-POWER MICROWAVE GENERATOR

BACKGROUND OF THE INVENTION

1. Field of the Invention

This invention relates to high-power microwave/mm-wave generators, and more particularly to oscillators which operate by coupling an electron beam to a slow electromagnetic wave in a plasma-loaded, rippled-wall waveguide.

2. Description of the Related Art

Several devices are known which function as high power microwave or mm-wave generators, such as virtualcathode oscillators (vircators), magnetrons, klystrons, gyrotrons, and backward-wave oscillators. Such devices are described in J. Feinstein and K. Felch, "Status Review of Research on Millimeter-Wave Tubes", *IEEE Transactions on Electron Devices,* Vol. ED-34, No. 2, February 1987, pp. 461–467; H. K. Florig, "The Future Battlefield: A Blast of Gigawatts?", *IEEE Spectrum,* March 1988, pp. 50–54; Gordon T. Leifeste et 11., "Ku-Band Radiation Produced by a Relativistic Backward Wave Oscillator", *J. Appl. Phys.,* 59(4), Feb. 15, 1986, pp. 1366–1378; and James Benford, "High Power Microwave Simulator Development", *Microwave Journal,* December 1987, pp. 97–105. With numerous variations, the approach generally is to couple an electron beam with an evacuated waveguide structure at a high vacuum, on the order of $10^{-6}$ Torr or less. A space-charge wave is induced on the electron beam and couples within the waveguide structure to an electromagnetic waveguide mode, and thereby emits microwave or mm-wave energy at the end of the guide.

Several limitations and disadvantages have been encountered with this approach. A high, or "hard", vacuum can be difficult to maintain at ultra high power levels. Also, the electrons in the beam establish a mutually repulsive space-charge, which without a controlling mechanism causes the beam to rapidly expand and destroy any beam focusing or collimation; this is referred to as space-charge blowup. As a consequence, a very strong magnetic field of up to 10 kGauss must be employed to confine the beam, which complicates the structure, reduces efficiency and adds to the expense of the microwave generator. Even when a magnetic field is used, a potential depression still occurs across the beam, and the negative potential reduces the beam voltage in the vicinity of its axis. The result is that the electrons slow down near the beam axis, a phenomenon referred to as axial velocity shear, which impedes the achievement of good coupling between the beam and the waveguide structure.

At very high output powers the prior devices cannot generate pulse lengths longer than a few hundred nanoseconds because they use field-emitting cathodes in their electron guns; these generate an expanding uncontrolled plasma surface in the evacuated high-voltage-diode electron gun gap. The plasma surface propagates from cathode to anode, shorting the gap in 100–1,000 nanoseconds, and thus terminating the pulse. Devices such as the vircator also use a metal-foil anode that self-destructs in about 100 nanoseconds.

The magnetic focusing required to counteract space-charge blowup needs a very strong magnetic field, on the order of 10 kGauss or more, and associated bulky magnets. The axial velocity shear produced by the space-charged fields also reduces the efficiency of the oscillator at high beam current densities.

Other types of electron guns include plasma anode devices, and wire ion plasma guns. The former device is described in U.S. Pat. No. 4,707,637 issued Nov. 17, 1987 in the name of Robin J. Harvey, while the latter is described in U.S. Pat. No. 4,025,818, issued May 24, 1977 in the name of Robert P. Giguere, both assigned to Hughes Aircraft Company, the assignee of the present invention. Another electron gun is described in U.S. Pat. No. 3,831,052, issued Aug. 20, 1974 in the name of Ronald C. Knechtli, and also assigned to Hughes Aircraft Company. The latter device is a hollow cathode gas discharge mechanism used to produce an electron beam with a rectangular cross-section for driving gas lasers. Current densities in the range of $10^{-4}$ to 1 amp/cm$^2$ are described. A discharge is struck through a gas within the cathode, between the cathode walls and a rectangular perforated anode which is situated within a cathode exit slit. A relative positive polarity is applied to the anode electrode to extract electrons from the plasma. The electrons are accelerated by a greater positive polarity on a control grid, and once past the control grid are further accelerated by a high voltage accelerating field between a thin foil window and the grid.

SUMMARY OF THE INVENTION

The purpose of the present invention is to provide an improved microwave/mm-wave oscillator for generating high power radiation, with long pulses of up to 100 microseconds, and to do so with a system that neutralizes electron-beam space-charge blowup without the use of externally applied magnetic fields. Increased efficiency, the avoidance of contamination in the system, an easy mechanism for coupling energy out of the system, an ability to easily adjust the frequency of the generated radiation, and a generally simplified and low cost construction are other advantages sought. An improved electron gun for use in the oscillator, capable of achieving much greater current densities than previously available, is a further aspect of the invention.

The invention accomplishes these goals by injecting a high current density electron beam, up to 100 A/cm$^2$, but at least about 1 amp cm$^2$, into a waveguide structure L having a "soft" vacuum within the approximate range of 1–20 mTorr, as opposed to the prior "hard" vacuum on the order of $10^{-6}$ Torr or less. The electron beam current density is high enough to at least partially ionize the gas within the waveguide. The gas pressure is kept at a level sufficiently low to avoid voltage breakdown in the electron gun, but sufficiently high to provide enough ions to substantially neutralize space-charge blowup of the beam and to remove the potential depression.

The oscillator can be implemented as a slow-wave tube, in which the waveguide housing has a rippled wall and single-mode, narrow-band, low-frequency microwave radiation is generated by maintaining the gas pressure within the approximate range of 1–5 mTorr. Broadband, high-frequency, noise-modulated microwave and mm-wave radiation is achieved by maintaining the gas pressure within the approximate range of 10–20 mTorr.

A new type of electron gun for achieving the high current density employs a hollow cathode, an apertured grid located adjacent to multiple outlets from the cathode, and means for establishing an electrical glow discharge through a gas between the cathode and the grid to generate a plasma within the cathode. The grid has a generally high transparency, but with apertures small enough to prevent the passage of plasma through the grid. A generally transparent anode on the opposite side of the grid from the cathode maintains a high positive electric potential to extract an electron beam from the plasma behind the grid. In the preferred embodiment of the electron gun, the inner cathode surface is formed from a chemically active metal, and the gas is doped with a trace amount of oxygen to form an oxide of the metal, thereby enhancing the secondary electron yield from the cathode and permitting operation in the lower pressure range. Beam losses are reduced by providing the cathode, grid and anode with respective sets of apertures that are mutually aligned. The grid, anode, and end surface of the cathode are curved concave with respect to the beam to geometrically focus the beam, while the outer surface of the hollow cathode is cylindrical to generate an electron beam with a substantially circular cross-section.

Further features and advantages of the invention will be apparent to those skilled in the art from the following detailed description of preferred embodiments, taken together with the accompanying drawings, in which:

DETAILED DESCRIPTION OF PREFERRED EMBODIMENTS

The microwave/mm-wave oscillator of the present invention uses a "soft", partially gas-filled vacuum tube to generate high-power electromagnetic radiation, as opposed to the prior "hard" (very high vacuum) tubes. It employs the conventional approach of coupling an electron beam space-charge wave to an electromagnetic waveguide mode. However, it significantly simplifies the engineering and manufacturing of a high power oscillator, while simultaneously amplifying its performance by a wide margin. This is accomplished by combining three synergistic plasma-assisted technologies. They include a stabilized plasma-cathode electron gun, beam transport in a low pressure gas by ion focusing and Bennett pinch, and enhanced coupling through refractive effects and collective beam-plasma interaction. These elements are synergistic because the gas used to generate the plasma in the electron gun is ionized by the beam to enable beam propagation without having to employ strong magnetic fields, and the ionized gas in the beam also enhances the coupling. The latter two effects cannot be obtained with conventional microwave tubes, because the gas would poison the cathode and/or cause breakdown in the high voltage gap of the electron gun.

Figure 1:
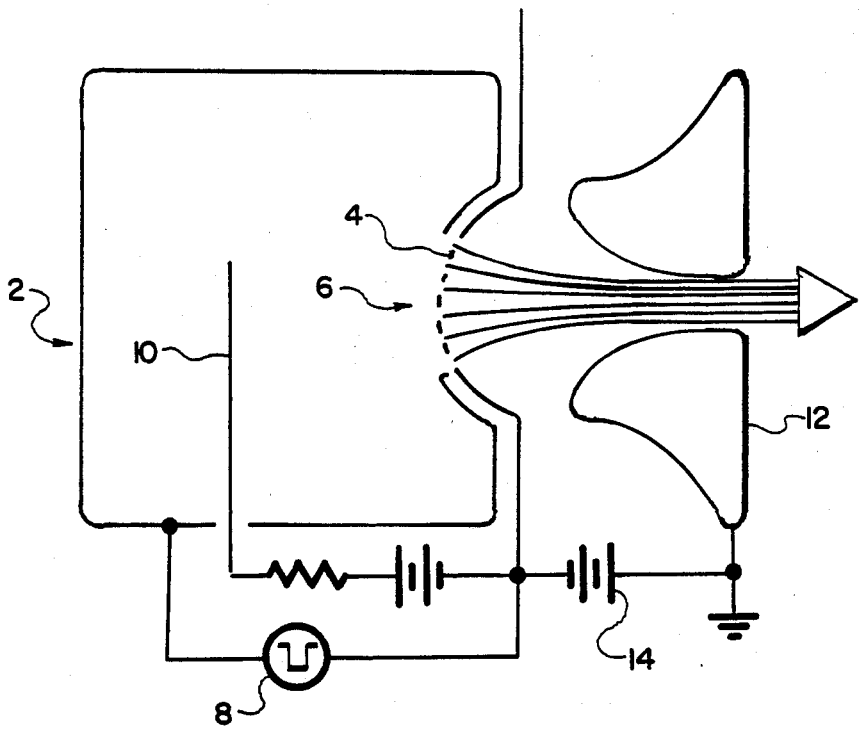
FIG. 1 is a diagram of a new electron gun configuration employed in the invention.

A new electron gun configuration is illustrated in FIG. 1. It employs a hollow cathode enclosure 2 which is filled with an ionizable gas at the desired pressure. Gases such as hydrogen and neon may be employed, but helium is preferred because of its ability to withstand high voltage levels.

A discharge grid 4 is located just outside an apertured outlet surface 6 in the hollow-cathode wall. A large cathode-to-grid area ratio is provided to produce an efficient confinement of ionizing electrons inside the hollow-cathode, and thus high density plasma generation at low gas pressures. A plasma is created and modulated within the hollow-cathode by applying to the hollow-cathode a negative pulse relative to the discharge grid, from a discharge pulser 8. A keep-alive anode wire 10 is inserted into the hollow-cathode and biased at about 1 kV to maintain a low current (about 10 mA) continuous discharge between pulses, so that the high current discharge pulse may be initiated on-command with low jitter. The discharge grid 4 has a high optical transparency on the order of about 80%, but with very small apertures of about 250-micron diameter through which electrons are extracted from the plasma. By controlling the plasma density with the discharge pulser and holding back the plasma behind the grid, long duration discharge pulses can be generated without having the plasma short out the structure at high voltage levels.

A high-density plasma, on the order of about $3\times10^{12}$ $cm^{-3}$ at 60 $A/cm^2$ current density, is formed behind the grid. Electrons are extracted from the plasma and accelerated to a high energy in a high current density emission by applying a high positive potential to an anode electrode 12, which is located on the opposite side of grid 4 from the hollow-cathode 2. Electric field stress in the gap between the anode 12 and grid 4 is held below a value which is limited by field emission and subsequent high voltage breakdown to about 100 kV/cm. The voltage may also be limited by Paschen breakdown if the product of the gas pressure and gap spacing, or Pd, exceeds a typical value of 0.3 Torr-cm. Paschen breakdown can be avoided at very high beam voltages by using a multi-stage accelerating scheme in which the total anode potential is graded over several anode structures separated b small gaps.

The hollow-cathode material in the electron gun comprises a metal, preferably a non-magnetic metal such as stainless steel, molybdenum, tungsten, or chromium. These materials provide adequate secondary-electron emission for operation of a hollow-cathode glow discharge. A high secondary electron yield discharge from the cathode may be obtained by coating the cathode surface with an oxide of a light, chemically reactive metal such as aluminum, beryllium or magnesium. This is achieved by forming the cathode from the desired metal, and doping the filler gas with a trace amount of $O_2$, preferably about 0.2 mTorr. This arrangement results in a thin layer of metallic oxide on the hollow-cathode surface, which lowers the work function and enhances the cathode's secondary electron yield. The higher yield increases the ionization rate, and allows the generation of a high density plasma at lower pressure. This in turn makes possible the use of large gap spacings for very high voltage electron guns, on the order of 400 kV, without suffering Paschen breakdown. The extraction voltage is provided to the anode by a high voltage source 14.

While a sufficiently high beam current density can theoretically be obtained by simply increasing the ratio of the anode emitting area to the spacing between the grid and anode, in practice the beam will become defocused when the anode aperture diameter becomes a significant fraction of the grid-anode gap. In accordance with the invention, however, a net high perveance (defined as $I/V^{3/2}$, where I is the beam space-charge-limited current and V is the anode voltage) is obtained by using multiple apertures. In the preferred embodiment, illustrated in FIG. 2, a hexagonal array of circular apertures in the hollow cathode is aligned with a similar array of apertures 30 in the anode and grid, so that the total perveance is equal to the perveance per aperture multiplied by the number of apertures. By using an electron-trajectory-following computer code which accounts for space-charge fields, the beam optics can be designed to generate an array of electron beamlets 32 which do not intercept the anode electrode 12. The cathode apertured outlet 6, discharge grid 4 and anode 12 are preferably curved concave with respect to the beam to obtain a geometric focusing of the beamlets 32, which merge into a single, circular cross-section beam 34 injected into the rippled waveguide housing 16.

Figure 3:
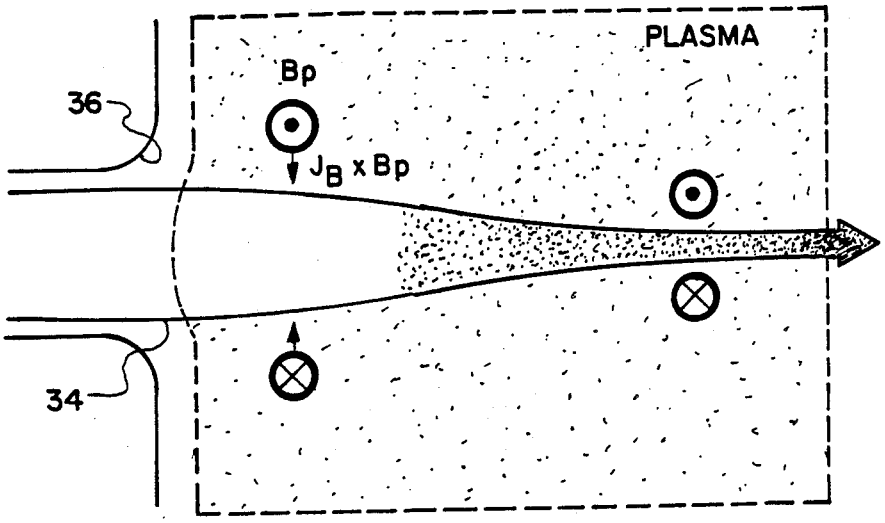
FIG. 3 is an illustration of the self-magnetic pinch effect which helps to confine the electron beam.

Ionization of the filling gas by the beam electrons produces ions that neutralize the beam and prevent spacecharge blowup. Stable beam propagation with an equilibrium beam diameter is obtained by balancing the remaining outward thermal pressure in the beam with the magnetic self-pinching Bennett force, and the electrostatic confining force of the positively charge ions. The magnetic force arises from the axial current in the beam producing an azimuthal magnetic field. This field acts back upon the current, as shown in FIG. 3, to generate an inward-directed force on the beam 34 as it emerges from an anode aperture 30.

Figure 4:
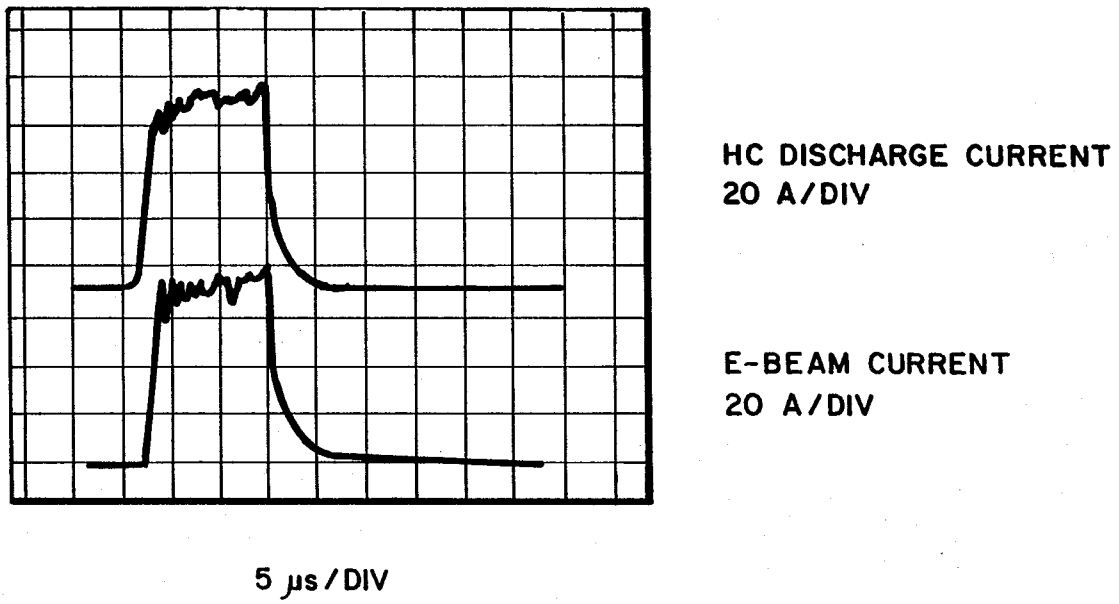
FIG. 4 is a set of graphs showing the hollow-cathode and beam current pulses produced with a demonstration of the invention.
Figure 5:
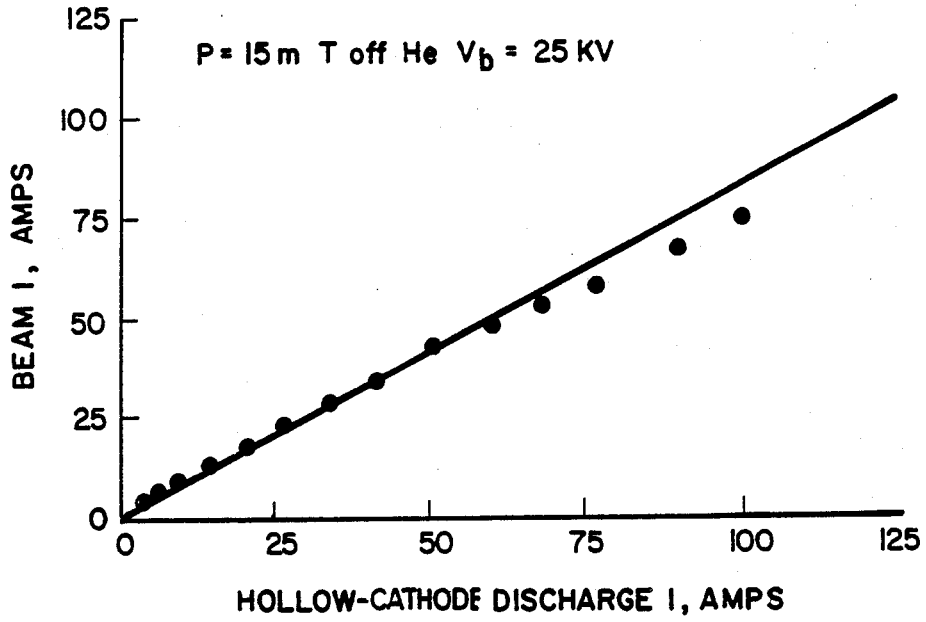
FIG. 5 is a graph of the electron beam current as a function of the hollow-cathode discharge current.
Figure 6:
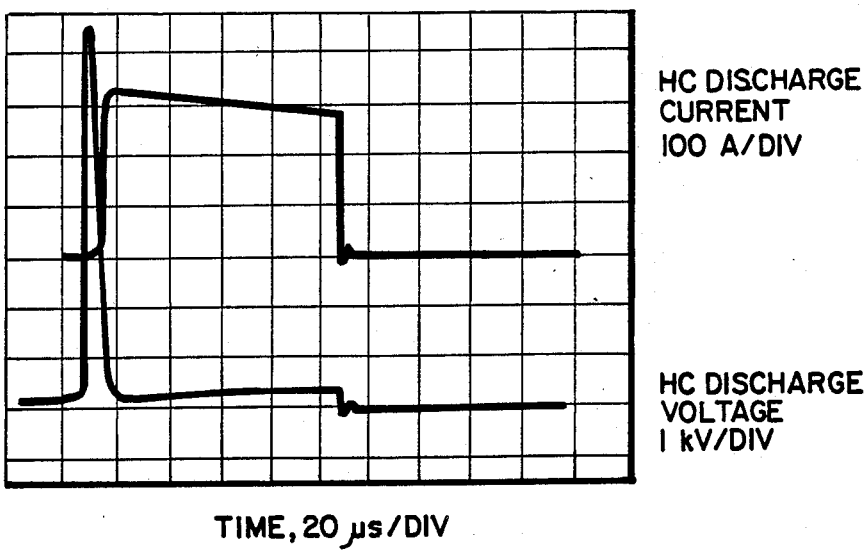
FIG. 6 is a graph of the hollow-cathode discharge current and discharge voltage as a function of time.

FIG. 4 shows oscillograms of the hollow-cathode discharge and the beam current pulses for a reduction to practice of the electron gun operating at 53 kV, with a current density of 14 A/cm$^2$, and a pulse length of 12 microseconds. The beam current can be controlled linearly up to a space-charge limited (SCL) level by varying the hollow-cathode discharge current, as shown in FIG. 5. The ratio of the two currents is almost identically equal to the hollow-cathode-grid transparency. The 5-cm$^2$ cathode was demonstrated to be capable of supplying 60 A/cm$^2$ of emission over a 100 $\mu$s-long pulse by operating the hollowcathode discharge at 300 A for 100 $\mu$s; the discharge current and voltage are shown in FIG. 6. In general, long beam pulses on the order of about 1–100 $\mu$s are preferred.

The described electron gun is used to inject an electron beam into a waveguide structure. The operating characteristics of the assembly can be controlled simply by controlling the internal gas pressure. With a gas pressure in the approximate range of 1–5 mTorr, the assembly can be constructed to function as a slow-wave tube, with a microwave output. Slow-wave oscillator operation is not achieved at pressures significantly less than 1 mTorr, due to the lack of sufficient plasma to prevent space-charge blowup of the beam. With a higher pressure, in the approximate range of 10–20 mTorr, the assembly can function as a plasma-wave-tube with a broadband microwave and/or mm-wave radiation output. Lower gas pressures will generally not produce sufficient plasma for the plasma-wave-tube mode of operation, while substantially higher gas pressures will tend to cause a breakdown in the electron gun. For the slow-wave tube application, a minimum electron beam current density of about 1 A/cm$^2$ has been found to be necessary to generate electromagnetic radiation; a minimum of about 10 A/cm$^2$ has been found to be necessary for the plasma-wave-tube application. Typical beam current densities are in the 50–100 A/cm$^2$ range.

Figure 2:
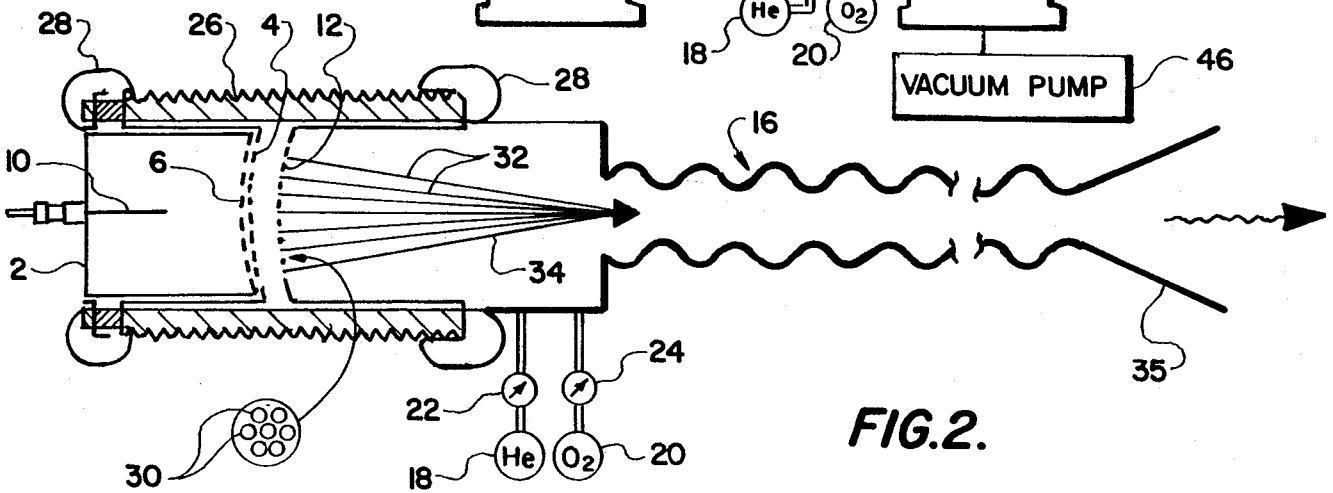
FIG. 2 is a sectional view of a preferred multiaperture electron gun coupled with a rippled waveguide to form a slow-wave tube with a microwave output.

A slow-wave tube formed by coupling the novel electron gun with a conventional rippled waveguide housing 16 is shown in FIG. 2. The electron gun and waveguide housing are supplied with helium gas from a reservoir 18, and a trace amount of oxygen from a reservoir 20, through respective needle valves 22 and 24; other gas supplies such a $ZrH_2$ gas reservoir which is heated to emit hydrogen could also be used. An insulating bushing 26 is provided around the exterior of the gun, with electrical connections (not shown) made to the hollow cathode 2, discharge grid 4 and anode 12 through connectors 28.

The rippled waveguide 16 acts as a slow-wave structure to reduce the phase velocity of the electromagnetic waveguide mode so as to match the speed of the electron beam, which drifts at less than the speed of light. Space-charge waves on the beam can then be resonantly coupled to waveguide modes to transfer energy from the beam to the microwave fields. Since the beam is not perturbed to the first order in the transverse direction as in a free electron laser, the beam electrons interact primarily with the axial components of the microwave field, which are supported by the ripples in the waveguide. Thus, primarily transverse magnetic (TM) modes are generated. An output horn antenna 35 radiates the output electromagnetic energy into a preferred direction in space.

The presence of plasma in the waveguide further amplifies the growing waves because the refractive effect of the plasma increases the wavelength of the radiation, thus increasing the coupling effect of the beam with the slow-wave structure. Excitation of electron-plasma wave harmonics from the beam-plasma interaction is also believed to enhance beam bunching and slow-wave coupling.

In the preferred embodiment of the invention, the beam current is sufficiently high so that the gain of the microwave fields in one transit of the beam through the waveguide is substantially greater than unity. Thus, the invention will be able to operate as a high-power oscillator without the need for reflecting a portion of the radiation back into the waveguide to make the waveguide function as a cavity. However, in alternative embodiments, a low current beam may be used in the regime where the gain is less than unity. In this case, reflectors can be positioned at the ends of rippled waveguide to form a high-Q cavity. The cavity would then be able to trap the growing microwave fields and allow very narrow linewidth oscillator operation with low beam current. Reflectors usable in such a configuration are described for example in pending patent application Ser. No. 031,327, filed Mar. 27, 1987, for "Ideal Distributed Bragg Reflectors and Resonators", in the name of R. J. Harvey, and U.S. Pat. No. 4,697,272, issued Apr. 6, 1987, in the name of R. J. Harvey, for "Corrugated Reflector Apparatus and Method for Free Electron Lasers", both assigned to Hughes Aircraft Company, the assignee of the present invention.

Figure 8:
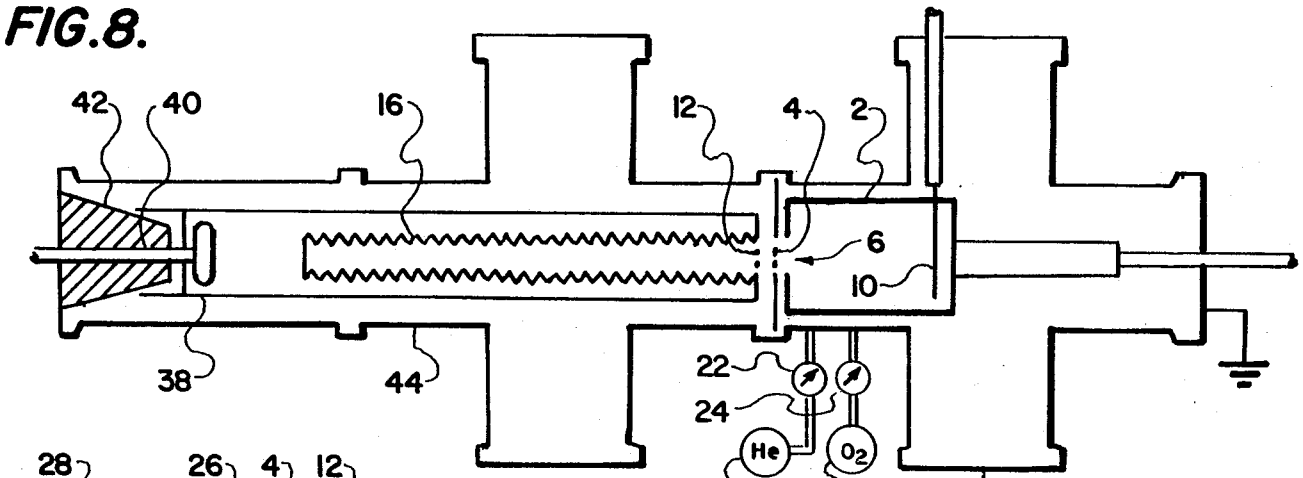
FIG. 8 is a sectional view of an experimental system used to demonstrate the slow-wave tube application of the invention.

A reduction to practice of the slow-wave tube is shown in FIG. 8; elements in common with those shown in prior figures are identified by the same reference numerals, and similar electrical supply circuitry (not shown) would be used. The rippled waveguide 16 was implemented as a common flexible copper water pipe. The average radius was 9.2 mm, the difference between minimum and maximum radius was 2.2 mm, and the ripple period was 7.6 mm. The anode voltage wa provided from an anode extension tube 38 fed by a lead 40 through a bushing 42. The entire assembly was furnished within a grounded vacuum housing 44, which was evacuated by a vacuum pump 46.

Figure 7:
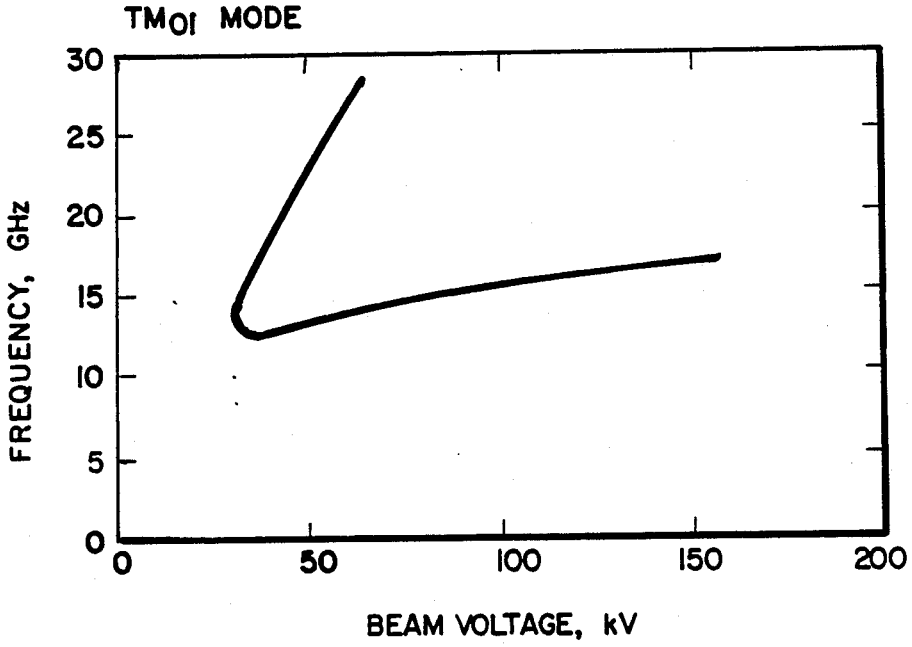
FIG. 7 is a graph of the output frequency as a function of the beam voltage.

A plot of the predicted output frequency for the slow-wave tube of FIG. 8 as a function of beam voltage is provided in FIG. 7. This curve predicts that the lowest frequency cut-off mode will be excited at about 12 GHz when the beam voltage is tuned to about 25 to 30 kV. At low beam currents, at which the growth rate of the slow waves is low and the gain per pass through the waveguide is less than unity, the device is expected to oscillate only at cut-off, because at this frequency the waveguide functions as a high-Q cavity. The open ends of the waveguide reflect the microwave signals and tap the signal wave, thus allowing the wave fields to grow to large amplitude.

True slow-wave oscillator operation was observed by operating the hollow-cathode gun at a low helium pressure of 4 mTorr, so that a plasma of sufficient density was generated in the waveguide to obtain good beam transport, but without generating so much plasma that the slow-waves were shorted out by the plasma itself. This required that the microwave signal frequency be above the plasma frequency, so the plasma density was less than $2\times10^{12}$ cm$^{-3}$. The system was doped with 0.2 mTorr of oxygen to permit operation at this low helium pressure.

With the beam current set at 30–35 A, the beam voltage was scanned over the 10–41 kV range. Frequency responses were observed which were consistent with the excitation of the cut-off $TM_{01}$ at 12–13 GHz, which was predicted to occur at about 30 kV (see FIG. 7).

Figure 9:
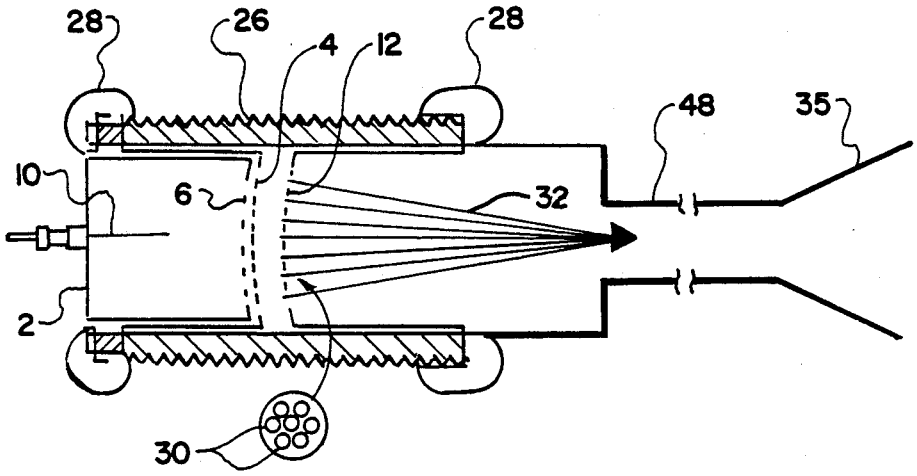
FIG. 9 is a sectional view of the preferred multi-aperture electron gun coupled with a cylindrical waveguide to form a plasma wave tube with a microwave or mm-wave output.

The plasma-wave-tube application of the present invention is illustrated in FIG. 9. The same electron gun is used as in the slow-wave tube application, and is indicated by the same reference numerals. In the plasma wave tube application, however, the waveguide wall need not be rippled. A smooth cylindrical waveguide housing 48 is provided instead of the rippled housing of the slow-wave embodiment.

It has been found that, with a "soft" gas pressure inside the tube, an electron beam with a high current density will at least partially ionize the gas, and form a very large amplitude plasma wave. With a sufficiently high beam current density, the plasma density will be modified in a periodic fashion so that it appears as a scattering structure to the plasma waves; this in turn produces a backscattered plasma wave. The result in effect is a pair of counterstreaming plasma waves, produced from a single electron beam, which couple nonlinearly within the plasma to generate electromagnetic radiation. Previously, two separate electron beams have had to be used for this purpose, as described for example in copending U.S. patent application Ser. No. 181,340, "Improved Plasma Wave Tube", filed Apr. 14, 1988 in the name of Robert W. Schumacher et al. and assigned to Hughes Aircraft Company, (attorney Docket No. PD-87441.

Along with inducing a pair of counterstreaming plasma waves, the electron beam produces sufficient ions of the gas to effectively neutralize the space-charge in the beam, thus preventing space-charge blowup and keeping the beam confined without the use of magnetic fields. The result is a higher power output, and the avoidance of the space-charge voltage depression, axial velocity shear, complexity and expense associated with magnetic systems.

Plasma wave tube operation was demonstrated by increasing the helium gas pressure to 15 mTorr, which increased the plasma density in the waveguide. In this mode the slow-wave oscillation frequency is less than the plasma frequency, and the plasma density is higher than $2\times10^{12}$ cm$^{-31\ 3}$. The electron beam drives intense electron plasma waves, which nonlinearly modulate the background plasma, producing near-zero frequency plasma structures. The forward driven waves scatter off the structures, producing backscattered plasma waves. Finally, the forward and backward propagating waves couple to generate a waveguide mode at a frequency equal to twice the plasma frequency. Since the plasma is rather non-uniform, there is a spread in the plasma frequency, and consequently a broadband output microwave/mm-wave frequency.

Figure 10:
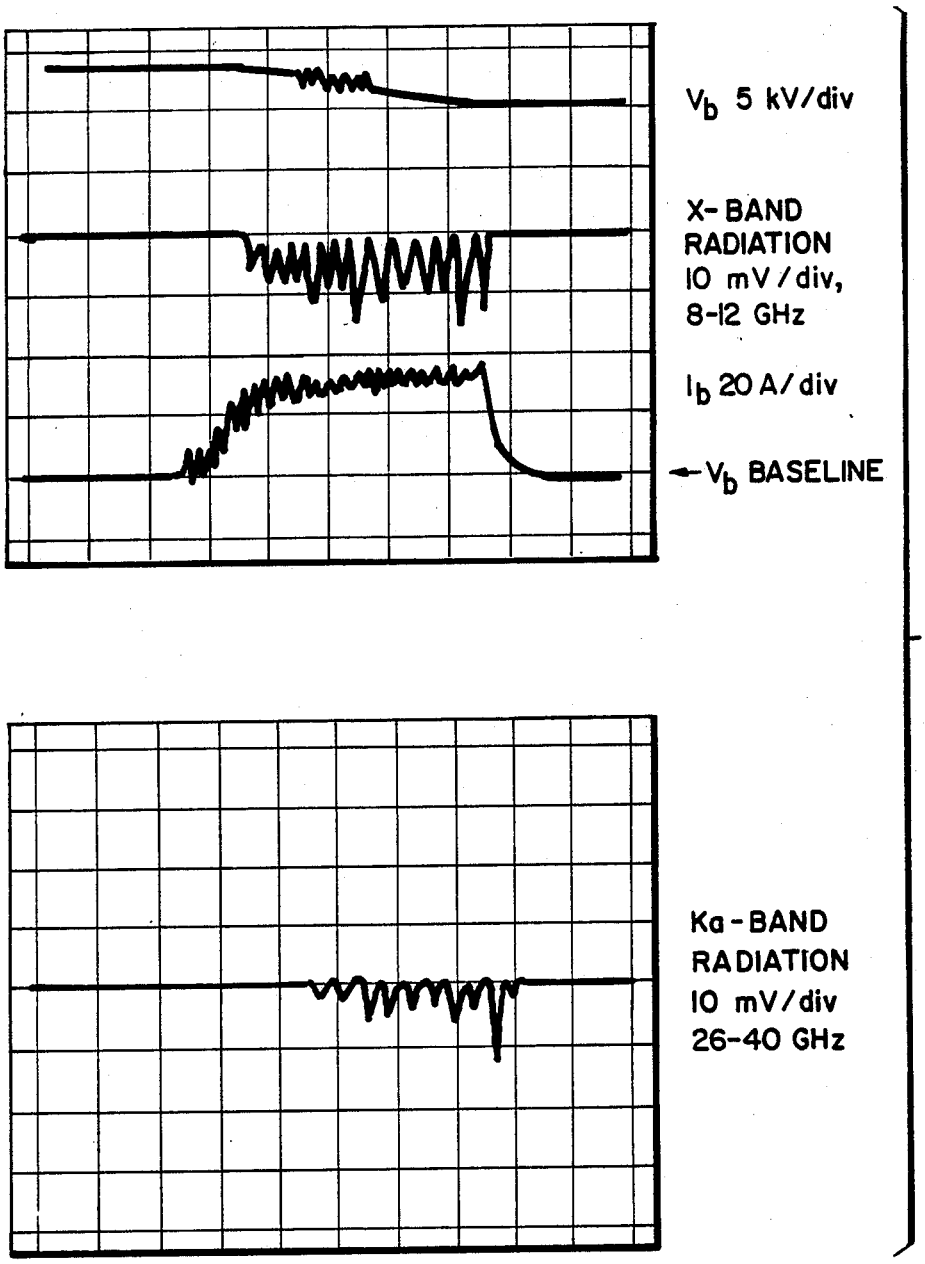
FIG. 10 is a set of graphs showing the frequency response obtained with a demonstration of the plasma wave tube.

FIG. 10 is a series of graphs of oscilloscope traces showing the broadband output achieved with a system operated at 15 mTorr of helium, a discharge voltage of 33 kV and a discharge current of 30 A. An X-band filter was used to detect the low end of the frequency output. Although most efficient over a range of about 8 to 12 GHz, X-band detectors are high pass filters that are also sensitive to higher frequencies. The lower limit of the output frequency was calculated to be 15 GHz, based upon the waveguide dimensions and plasma density. A frequency response up to about 40 GHz in the Ka-band was observed.

The above demonstration has significant impact upon plasma wave tube development, because it proves that plasma wave tube radiation can be driven by a single high current density beam. Previously, when only low current density beams less than 2 A/cm$^2$ were used, a pair of counterstreaming beams was always required. The use of only a single beam simplifies plasma wave tube construction, output coupling, and beam-energy recovery.

While the new electron gun described herein as part of the invention has a primary application to slow-wave tubes and plasma wave tubes, it may also be useful for other applications. These could include the use of the electron gun to drive a laser, or to expose resist in connection with electron-beam lithography.

Several embodiments of the invention have thus been shown and described. Since numerous variations and alternate embodiments will occur to those skilled in the art, it is intended that the invention be limited only in terms of the appended claims.

We claim:

1. An oscillator for generating electromagnetic radiation within the microwave to millimeter-wave range, comprising:

a waveguide housing, means for introducing an ionizable gas into said waveguide housing, an electron gun for injecting an electron beam into said waveguide housing, and means for maintaining the gas pressure within said waveguide housing at a level sufficiently low to avoid a voltage breakdown of the beam, and sufficiently high to provide enough ions to substantially neutralize space-charge expansion of the beam, said electron gun injecting said beam into the waveguide housing with a sufficient current density to at least partially ionize the gas therein and generate electromagnetic radiation at said gas pressure.

2. The oscillator of claim 1, wherein said gas pressure is maintained within the approximate range of 1–20 mTorr.

3. The oscillator of claim 2, implemented as a slow-wave tube, said waveguide housing having a rippled wall, wherein said gas pressure is maintained within the approximate range of 1–5 mTorr.

4. The oscillator of claim 2, implemented as a plasma wave tube, wherein said gas pressure is maintained within the approximate range of 10–20 mTorr.

5. The oscillator of claim 1, wherein said electron gun generates a beam with a current density of at least about 1 amp/cm$^2$.

6. The oscillator of claim 5, said electron gun comprising a hollow cathode having an outlet, an apertured grid at said cathode outlet, means for introducing an ionizable gas into said hollow cathode, means for establishing an electrical glow discharge between the cathode and the grid to generate a plasma within said cathode, the grid having a generally high transparence but with apertures small enough to prevent the passage of plasma through it, a generally transparent anode on the opposite side of the grid from the cathode, and means for applying an electrical potential to said anode to extract an electron beam from the plasma behind said grid.

7. The oscillator of claim 6, wherein the inner cathode surface is formed from a chemically active metal, and said gas introducing means includes means for doping the gas with a trace amount of oxygen to react with said metal and form an oxide thereof, thereby enhancing the secondary electron yield from the cathode.

8. The oscillator of claim 6, wherein said hollow cathode and anode have respective sets of apertures which are mutually aligned to yield a high perveance beam.

9. The oscillator of claim 6, wherein the cathode surface, grid and anode are curved concave with respect to the beam to geometrically focus the beam.

10. The oscillator of claim 6, said hollow cathode being cylindrical to generate an electron beam with a substantially circular cross-section.

11. The oscillator of claim 1, wherein said means for introducing an ionizable gas into the waveguide housing also introduces said ionizable gas into the electron gun at a pressure approximately equal to the pressure within the waveguide housing.

12. The oscillator of claim 11, said electron gun including means for establishing an electrical glow discharge through the ionizable gas within said gun to establish a plasma therein, said plasma providing an electron source for said beam.

13. The oscillator of claim 12, said electron gun including means for producing said discharge in pulses of about 1–100 μsecond duration.

14. The oscillator of claim 1, said electron gun injecting an electron beam into one end of the waveguide housing, and further comprising a horn antenna at the opposite end of the waveguide housing for emitting output electromagnetic radiation.

15. An oscillator for generating electromagnetic radiation within the microwave to millimeter-wave range, comprising:

(a) a waveguide housing, (b) an electron gun coupled to said waveguide housing for injecting an electron beam into said waveguide housing, (c) means for introducing an ionizable gas into the waveguide housing and electron gun at a pressure sufficiently low to avoid a voltage breakdown of the beam, and sufficiently high to provide enough ions within the waveguide housing to substantially neutralize space-charge expansion of the beam, and (d) said electron gun comprising:

(i) a hollow cathode having multiple outlets to said waveguide housing, (ii) a perforated grid located adjacent to said multiple cathode outlets, said grid having apertures small enough to prevent the passage of plasma, (iii) means for establishing an electrical glow discharge between the cathode and the grid to generate a plasma within the cathode, (iv) a perforated anode on the opposite side of the grid from t he cathode, and (v) means for applying an electrical potential to said anode to extract an electron beam from the plasma behind the grid into said waveguide housing, said electron gun generating said beam with a sufficient current density to at least partially ionize the gas therein and generate electromagnetic radiation.

16. The oscillator of claim 15, wherein said cathode has an inner cathode surface formed from a non-magnetic metal.

17. The oscillator of claim 15, wherein said cathode has an inner cathode surface formed from a chemically active metal, and said gas introducing means includes means for doping the gas with a trace amount of oxygen to react with said metal and form an oxide thereof, thereby enhancing the secondary electron yield from the cathode.

18. The oscillator of claim 15, wherein said cathode outlets and anode have respective sets of apertures which are mutually aligned to yield a high perveance beam.

19. The oscillator of claim 15, wherein said cathode, grid and anode are curved concave with respect to the beam to geometrically focus the beam.

20. The oscillator of claim 15, said hollow cathode being cylindrical to generate an electron beam with a substantially circular cross-section.

21. Apparatus for generating a generally non-spreading electron beam, comprising:

an electron gun for generating an electron beam, a housing coupled to the electron gun for receiving the electron beam, and means for introducing an ionizable gas into said housing for ionization by the beam, said gas being introduced at a pressure at which sufficient ions are generated in the vicinity of the beam to substantially neutralize space-charge blowup of the beam, said gun generating said beam with a sufficient current density to generate electromagnetic radiation within the housing at said gas pressure.

22. The beam generating apparatus of claim 21, wherein said gas is introduced into the housing at a pressure within the approximate range of 1–20 mTorr.

23. The beam generating apparatus of claim 21, wherein electron gun generates said beam with a current density of at least about 1 amp/cm$^2$.

24. An improved slow-wave tube, comprising:

a ripple-walled waveguide housing, means for introducing an ionizable gas into said housing at a pressure within the approximate range of 1–5 mTorr, and an electron gun for injecting an electron beam into said housing with a current density of at least about 1 amp/cm$^2$, said electron gun comprising:

(a) a hollow cathode having multiple outlets, (b) means for introducing an ionizable gas into the cathode, (c) a perforated grid located adjacent to said multiple cathode outlets, said grid having apertures small enough to prevent the passage of plasma, (d) means for establishing an electrical glow discharge between the cathode and the grid to generate a plasma within the cathode, (e) a perforated anode on the opposite side of the grid from the cathode, and (f) means for applying an electrical potential to said anode to extract an electron beam from the plasma behind said grid.

25. The improved slow-wave tube of claim 24, wherein said gas is helium.

26. An improved plasma wave tube, comprising:

A waveguide housing, means for introducing an ionizable gas into said waveguide housing at a pressure within the approximate range of 10–20 mTorr, and an electron gun for injecting an electron beam into said housing with a current density of at least about 10 amp/cm$^2$, said electron gun comprising:

(a) a hollow cathode having multiple outlets, (b) means for introducing an ionizable gas into the cathode, (c) a perforated grid located adjacent to said multiple cathode outlets, said grid having apertures small enough to prevent the passage of plasma, (d) means for establishing an electrical glow discharge between the cathode and the grid to generate a plasma within the cathode, (e) a perforated anode on the opposite side of the grid from the cathode, and (f) means for applying an electrical potential to said anode to extract an electron beam from the plasma behind said grid.

27. The improved plasma wave tube of claim 25, wherein said gas is helium.

28. The improved plasma wave tube of claim 26 wherein said waveguide housing has a smooth cylindrical wall and a single electron beam is injected into said housing to produce a pair of counterstreaming plasma waves.

29. An improved high current electron gun, comprising:

a hollow cathode having multiple outlets, means for introducing an ionizable gas into the cathode, a perforated grid located adjacent to said multiple cathode outlets, said grid having apertures small enough to prevent the passage of plasma, means for establishing an electrical glow discharge between the cathode and the grid to generate a plasma within the cathode, a perforated anode on the opposite side of the grid from the cathode, and means for applying an electrical potential to said anode to extract an electron beam from the plasma behind said grid.

30. The electron gun of claim 29, wherein the inner cathode surface is formed from a non-magnetic metal.

31. The electron gun of claim 29, wherein the inner cathode surface is formed from a chemically active metal, and said gas introducing means includes means for doping the gas with a trace amount of oxygen to react with said metal and form an oxide thereof, thereby enhancing the secondary electron yield from the cathode.

32. The electron gun of claim 29, wherein said cathode outlets and anode have respective sets of apertures which are mutually aligned to yield a high perveance beam.

33. The electron gun of claim 29, wherein said cathode, grid and anode are curved concave with respect to the beam to geometrically focus the beam.

34. The electron gun of claim 29, wherein said hollow cathode is cylindrical for generating an electron beam with a substantially circular cross-section.

* * * * *